US007931486B1

(12) United States Patent
Walters

(10) Patent No.: US 7,931,486 B1
(45) Date of Patent: Apr. 26, 2011

(54) ELECTRICAL CONNECTOR FOR MISSILE LAUNCH RAIL

(75) Inventor: James C. Walters, Cresson, TX (US)

(73) Assignee: Williams-Pyro, Inc., Fort Worth, TX (US)

( * ) Notice: Subject to any disclaimer, the term of this patent is extended or adjusted under 35 U.S.C. 154(b) by 0 days.

(21) Appl. No.: 12/824,161

(22) Filed: Jun. 26, 2010

(51) Int. Cl.
*H01R 13/62* (2006.01)

(52) U.S. Cl. ..... 439/320

(58) Field of Classification Search ..... 439/320, 439/578–585, 259, 310, 317, 598
See application file for complete search history.

(56) References Cited

U.S. PATENT DOCUMENTS

| | | | | |
|---|---|---|---|---|
| 2,281,511 | A * | 4/1942 | Parkin | 313/11.5 |
| 2,331,409 | A * | 10/1943 | Markey | 439/320 |
| 2,703,870 | A | 3/1955 | Minto | |
| 2,987,691 | A | 10/1958 | Ross | |
| 3,605,069 | A | 9/1971 | Dorrell | |
| 3,659,250 | A | 4/1972 | Horton | |
| 3,816,641 | A * | 6/1974 | Iversen | 174/76 |
| 4,580,865 | A | 4/1986 | Fryberger | |
| 4,900,260 | A | 2/1990 | Drogo | |
| 5,030,126 | A * | 7/1991 | Hanlon | 439/320 |
| 5,334,032 | A | 8/1994 | Myers | |
| 5,829,998 | A * | 11/1998 | Wandler et al. | 439/312 |
| 6,358,078 | B1 | 3/2002 | Crippa | |
| 6,425,776 | B1 * | 7/2002 | Fredl | 439/320 |
| 7,156,671 | B2 * | 1/2007 | Kauth | 439/98 |

* cited by examiner

*Primary Examiner* — Chandrika Prasad
(74) *Attorney, Agent, or Firm* — Morani Patent Law, PC

(57) ABSTRACT

An electrical connector for testing of a missile launch rail is provided. A stationary housing is combined with a coupling ring to form an outer housing. An internal plunger is housed in the outer housing and spans the length of the outer housing. The stationary housing anchors to the missile launch rail, while the coupling ring is free to rotate about the internal plunger. The coupling ring is rotated via a hand grasp. The coupling ring rotation translates into forward and aft movement of the pin assembly. The connector provides forward and backward stops for limiting pin insertion and extraction moves to desired distances. Rotation via triple-start threads readily overcomes insertion and extraction resistance of a bulky multi-pin assembly and provides a smooth and controlled electrical connection. The size of the connector approaches that of a small conventional military standard 38999 series III connector.

20 Claims, 9 Drawing Sheets

ELECTRICAL CONNECTOR FOR MISSILE LAUNCH RAIL

BACKGROUND OF THE INVENTION

The present invention relates generally to electrical connectors and more particularly to a device and method of providing repeatable consistent connection with an electrical connector for a missile launch rail.

Making electrical contact across multiple pins for continuity across industrial cables can be accomplished with a variety of conventional connectors to include military standard connectors such as a D38999 series connector. Testing of launch circuitry may be desired at periodic intervals. Testing of the launch connector or aircraft circuitry may be desirable as well. It would be desirable if multiple connecting and disconnecting operations could be done without damaging either the connector which is connected to the launch circuitry or the tester connector. A means for ensuring electrical contact between the launch connector and the tester connector is also desirable.

Ease of use of a connector is also desirable for test connectors to be used in areas of restricted accessibility, reach, and visibility. Conventional connectors may comprise a large lever or handle for a means of making or breaking electrical contact between contact pins of a male connector and contact pin receptacles of a female connector. In certain applications, such as testing aircraft circuitry for an air-intercept missile 120 (AIM-120) launcher rail, a means of assessing contact pin position, other than electrical measurements, may not be possible. A large conventional lever in excess of four inches in length and width may create an undesirable off axis moment about the connector. This can lead to stress, loosening, and bending of the connector pins. A large handle or lever may be difficult to manipulate within a launcher rail mechanism. It would be desirable to have a connector which did not induce undesirable forces on the electrical contact pins.

SUMMARY OF THE INVENTION

The present invention addresses some of the issues presented above by providing a method and device for displacing a set of connector pins with a controlled on axis force and a stop catch upon full pin insertion, while providing device reliability. Aspects of the present invention are provided for summary purposes and are not intended to be all inclusive or exclusive. Embodiments of the present invention may have any of the aspects below.

One aspect of the present invention is to ensure electrical connection by providing full pin insertion into the female plug of pin receptacles.

Another aspect of the present invention is to enable visual assessment of the pin position relative to the connector housing from a side view of any perspective about the connector's axis.

Another aspect of the present invention is to minimize any moment on the pins by using balanced on axis motion to displace the pin plunger.

Another aspect of the present invention is to provide controlled insertion and extraction of the pins from the female plug.

Another aspect of the present invention is to use alignment pins to ensure alignment of the desired pin configuration with the female plug.

Another aspect of the present invention is compatibility with conventional female military connectors to include conventional female connectors for missile launch rails.

Another aspect of the present invention is its ease of assembly and disassembly.

Another aspect of the present invention is relative ease of use in connecting to and testing of a the circuitry for a missile launcher rail.

Another aspect of the present invention is its ready insertion into and anchoring within a missile launcher rail.

Another aspect of the present invention is to provide an anchored testing connector in close proximity to a tethered conventional female connector on a missile launch rail.

Still another aspect of the present invention is the user friendly orientation and accessibility of both the mechanical and electrical coupling operation associated with male testing connector embodiments.

Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein.

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are illustrative of ways to make and use the invention, and are not intended to limit the scope of the invention. Parallel numbers across figures typically refer to like elements for ease of reference. Reference numbers may also be unique to a respective figure or embodiment and need not be consistent across figures.

Figure 1:
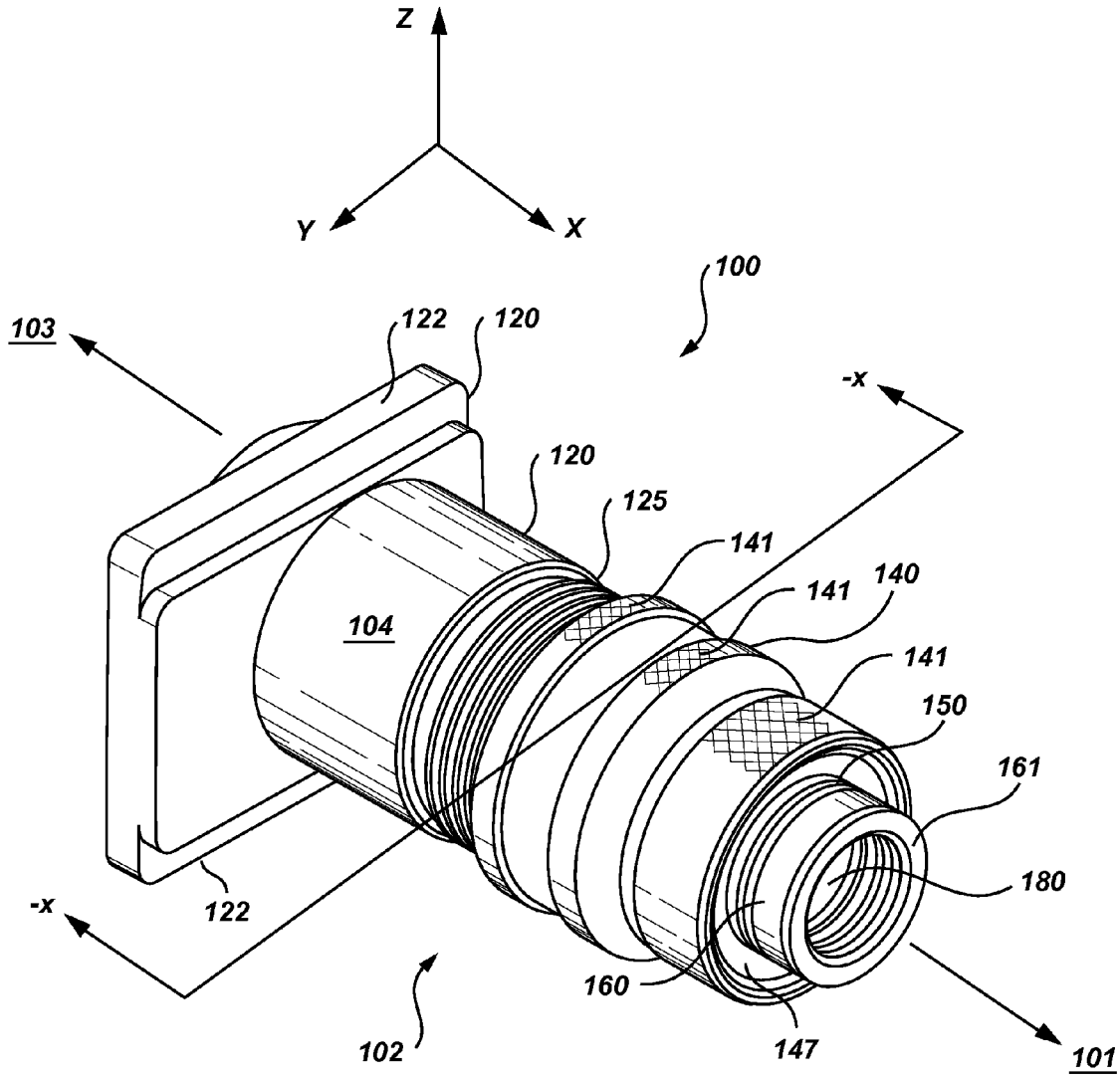
FIG. 1 shows a back perspective view of a connector in accordance with an embodiment of the present invention.

FIG. 1 shows a back perspective view of a connector in accordance with an embodiment of the present invention. The stationary housing 120 forms the front half of the connector, where the front end 103 connects to a female connector. An internal plunger 160 extends out the back end 101 of the connector. In the perspective view of FIG. 1, a left side 102 of the connector is in the foreground. The stationary housing 120 comprises a launcher rail mount 122. A portion of the threads of the stationary housing 125 are shown next to an edge of the coupling ring 140. A rear washer 147 and a snap ring 150 are visible from an opening in the coupling ring 140 facing the back end 101. The snap ring 150 is secured around the plunger 160. A desired cable extends into the plunger 160 through opening 180. Reference 104 indicates a top side surface of a connector. A rough or grooved surface 141 is shown in the coupling ring 140 for gripping the coupling ring and for a tactile or visual reference of coupling ring position.

Figure 2:
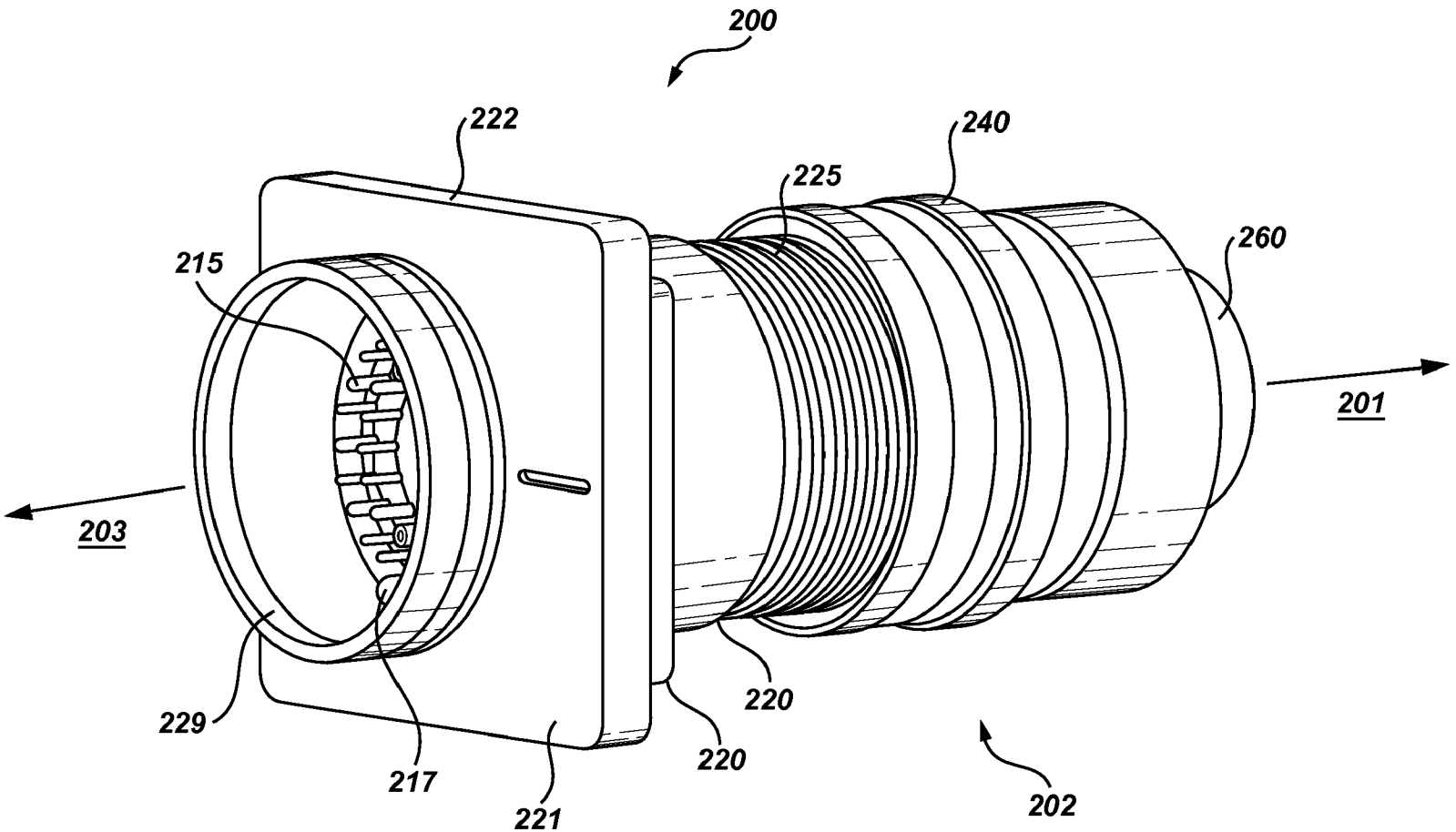
FIG. 2 shows a front perspective view of a connector in accordance with an embodiment of the present invention.
Figure 3:
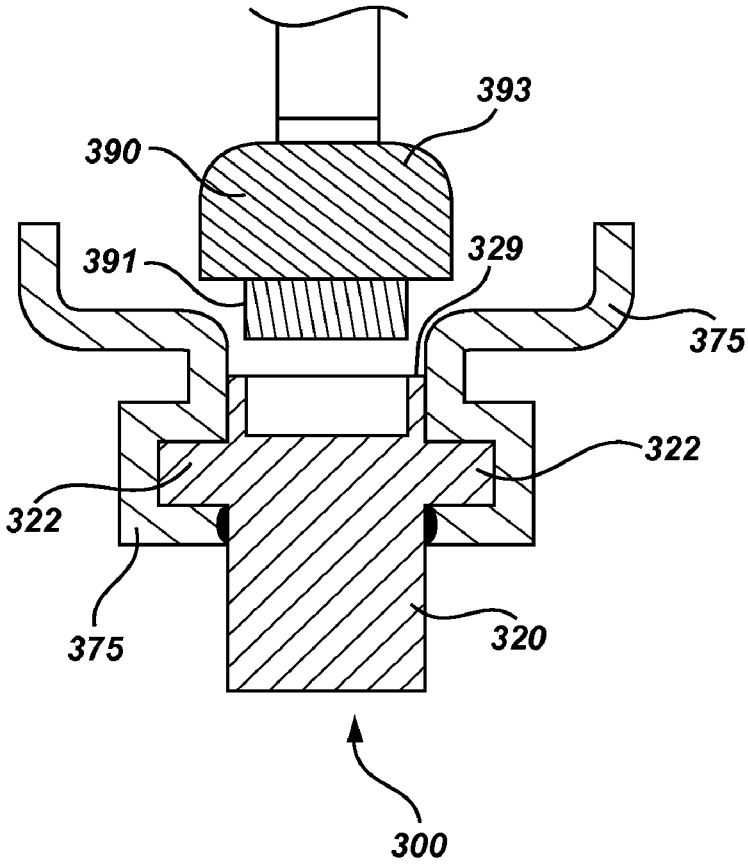
FIG. 3 shows a launcher rail engaging an exemplary connector in accordance with an embodiment of the present invention.

FIG. 2 shows a front perspective view of a connector in accordance with an embodiment of the present invention. The coupling end 229 of the stationary housing 220 forms the front 203 portion of the connector, which mechanically connects to a female connector. An internal plunger 260 extends out an opening in the coupling ring 240 towards the back end 201 of the connector. In the perspective view of FIG. 2, the rail side 221 of the launcher rail mount 222 is visible. In practice, the rail side 221 of the launcher rail mount 222 will face the launcher rail. An exemplary launcher rail is shown in FIG. 3. Referring to FIG. 2, a portion of the threads of the stationary housing 225 are shown next to an edge of the coupling ring 240.

FIG. 3 shows a cross-sectional block diagram of an exemplary launcher rail engaging an exemplary connector in accordance with an embodiment of the present invention. The launcher rail mount 322 fits inside the launcher rail frame 375 to hold the stationary housing 320 stationary. The coupling end 329 of the stationary housing 320 is exposed for receipt of a female connector 390. Mounting the connector in the missile launch rail, provides proximity to tethered conventional female connectors. Exemplary embodiments of the present invention are compatible with multiple conventional missile launch rails. Rail 375 is shown for illustrative purposes and a conventional launcher rail may be configured differently, while maintaining a grasp on the launcher rail mount 322 and an opening for access to the coupling end 329 of the stationary housing 320. Alternate embodiments of the present invention may have a different launcher rail mount configuration 322 to securely fit into and anchor into a desired launcher rail frame 375. Connector 390 may itself be tested or the connector may provide a connection for testing of associated launch circuitry. Connector plug 391 extends out from the female connector housing 393 for insertion into the coupling end 329 of the stationary housing. Additional details of an internal plunger and a stationary housing in accordance with the present invention are not shown in FIG. 3.

Figure 4:
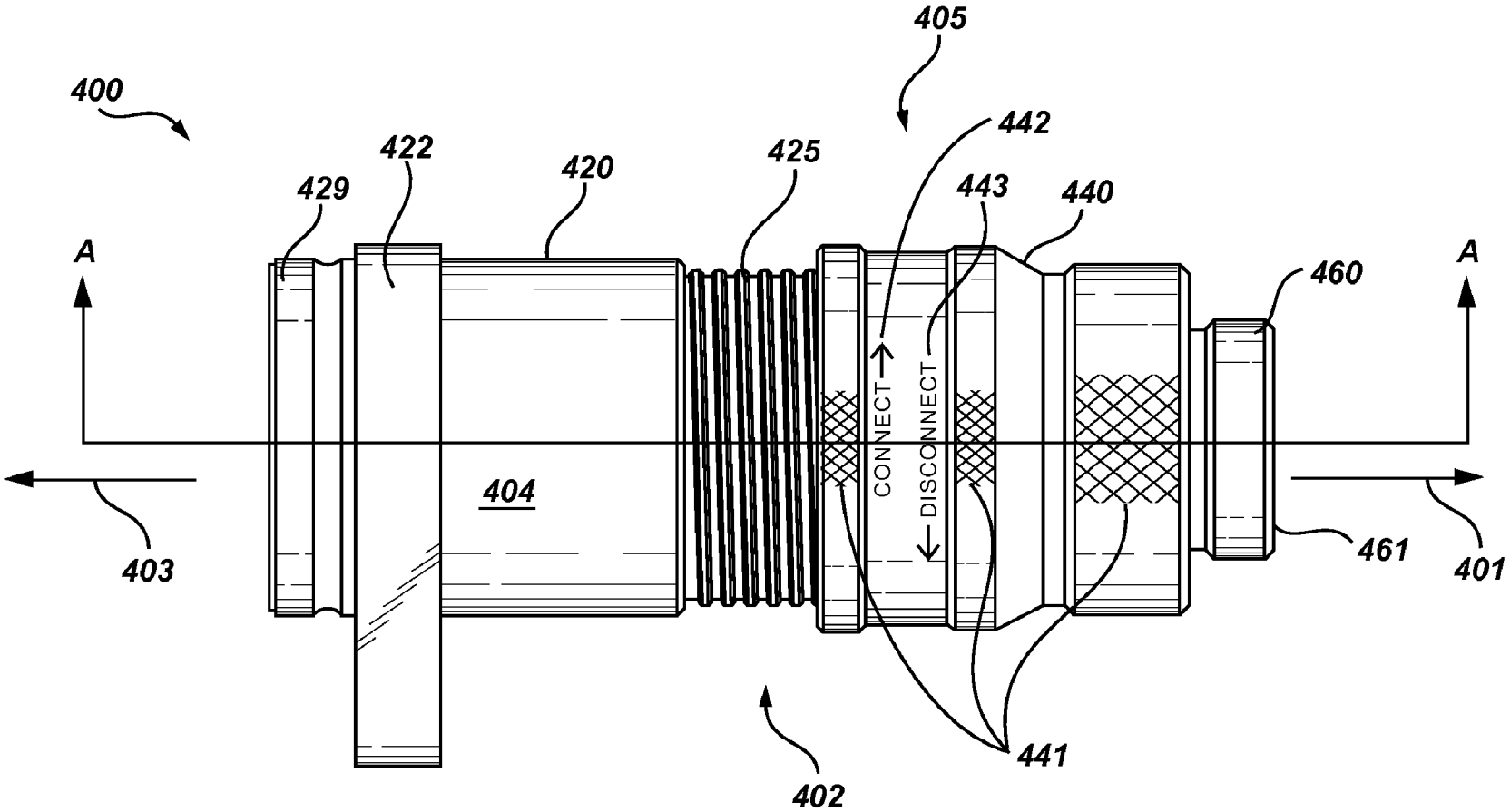
FIG. 4 shows a top view of connector in accordance with an exemplary embodiment of the present invention.

FIG. 4 shows a top view of a connector in accordance with an exemplary embodiment of the present invention. The asymmetry of the launcher rail mount 422 from left 402 to right 405 sides can be seen from the top 404 view. The configuration of the launcher rail mount 422 may vary across embodiments to accommodate different future and conventional launcher rails. The coupling end 429 faces the front 403 while the plunger 460 extends out of the coupling ring 440 towards the back 401 of the connector. An open coupling end 429 of a male testing connector in accordance with exemplary embodiments of the present invention does not include a threaded collar for mechanical coupling to a corresponding female connector. Rough or grooved surfaces 441 are shown on the coupling ring 440 for gripping the coupling ring and for a tactile or visual reference of coupling ring position. In addition, FIG. 4 shows direction indicators 442, 443 for connecting and disconnecting the connector 400 from a female connector. Threads 425 on the stationary housing 420 are visible.

Figure 5A:
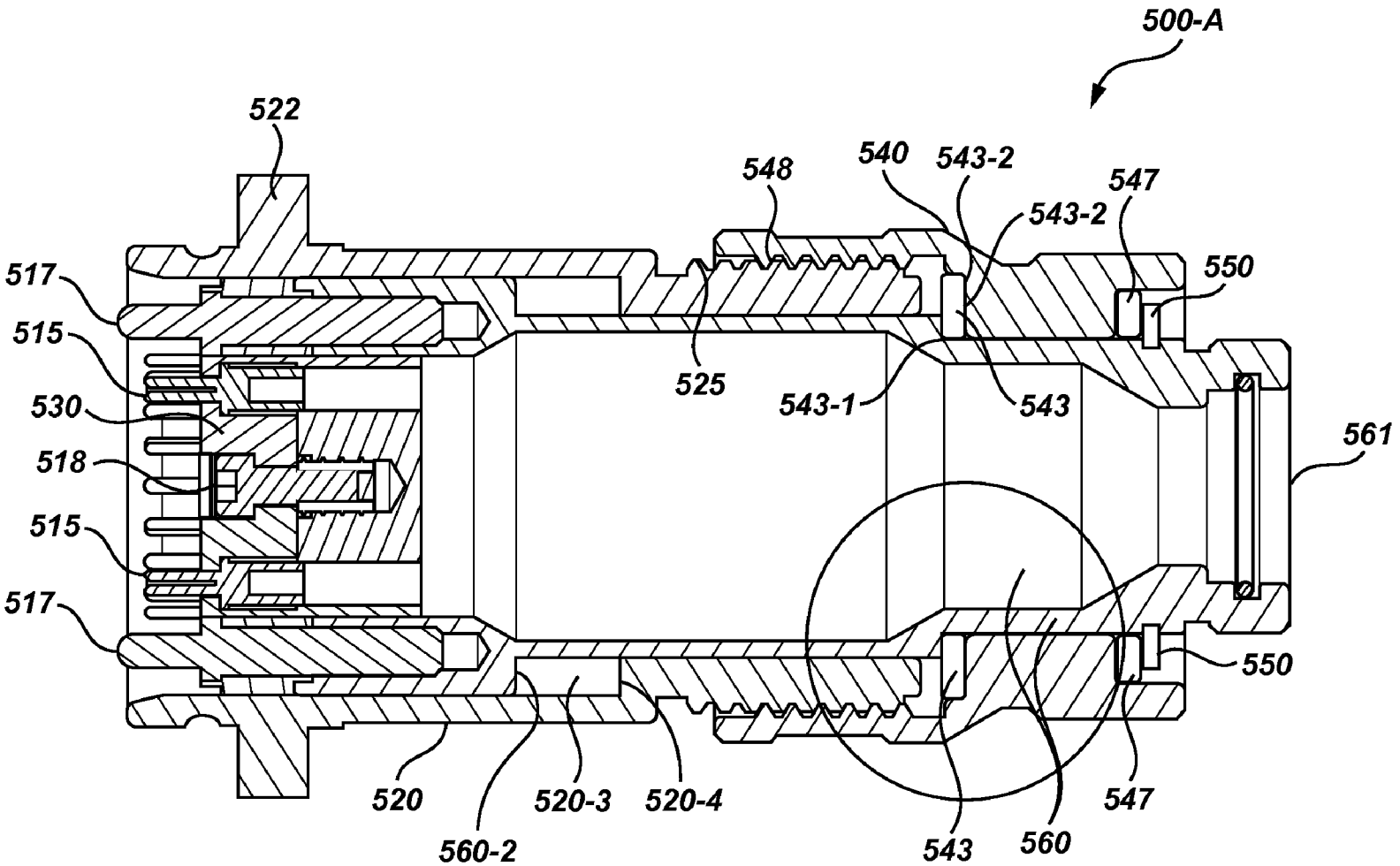
FIGS. 5A and 5B show cross sections of a connector along line A-A of FIG. 4, in accordance with an embodiment of the present invention, with the internal plunger in forward and aft positions, respectively.
Figure 5B:
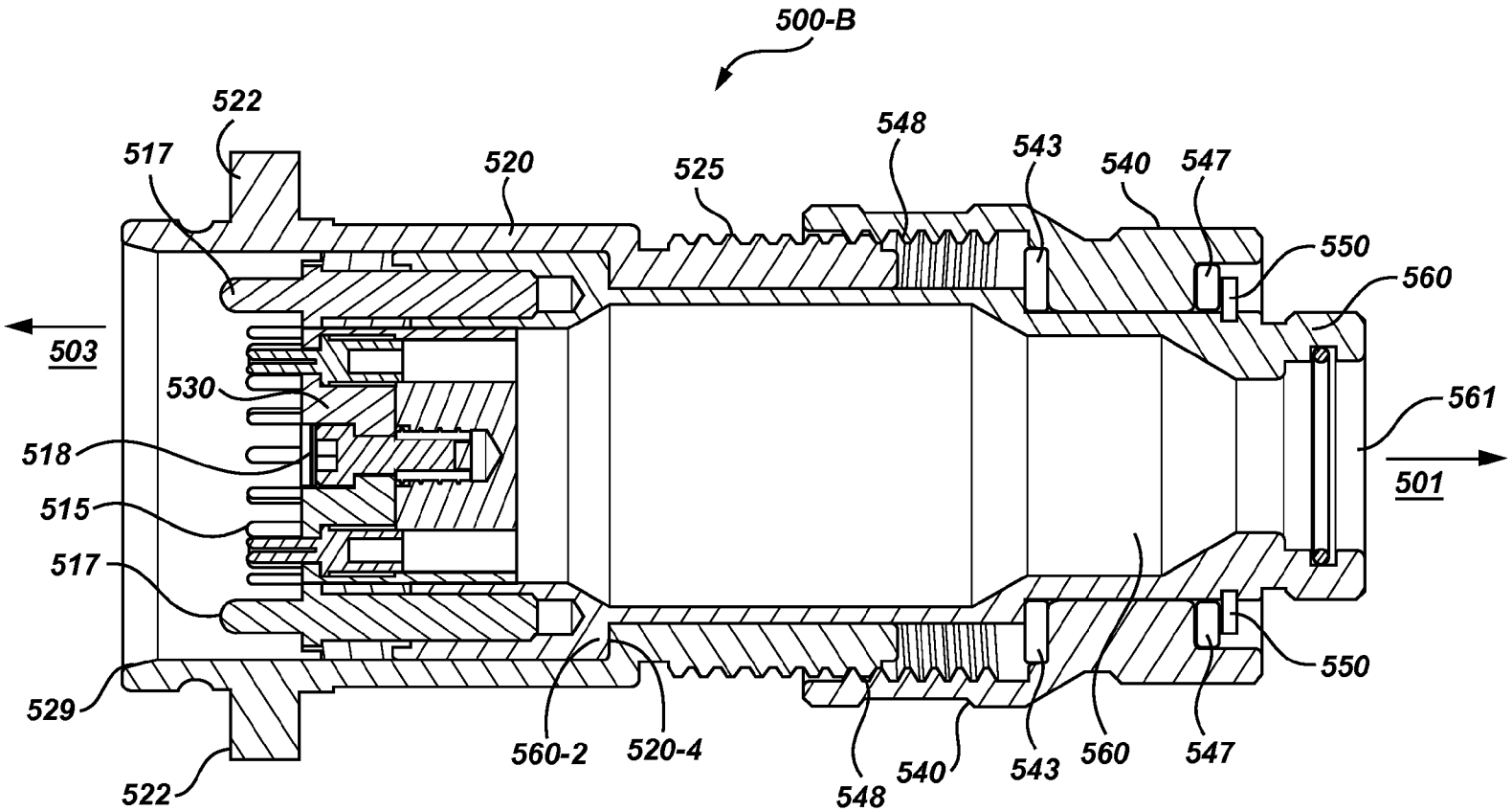

FIGS. 5A and 5B show cross sections of a connector along line A-A of FIG. 4, in accordance with an embodiment of the present invention, with the internal plunger in forward and aft positions, respectively. Turning first to FIG. 5B, showing the internal plunger 560 in the aft or rear position relative to the stationary housing 520. Alignment pins 517 extend toward the front 503 beyond the pin contacts 515. The coupling end 529 of the stationary housing 520 extends beyond the insertion points of the alignment pins 517. Alignment pins 517 extend forward past the contact pins 515. The collection of pins are mounted in a pin plug 530 and a center screw 518 is coupling the pin plug 530 to the internal plunger 560. Center screw 518 is recessed and contributes to the ease of assembling embodiments of the present invention. Contact pins 515 with pin plug 530 and alignment pins 517 are secured to the internal plunger 560 and move as a unit.

Towards the back end 501 of the connector, a snap ring 550 clamps around an outer circumference of an internal plunger 560. A rear washer 547 is positioned just forward of the snap ring and just aft of an edge of the coupling ring 540. As also shown in FIG. 1, a rear end 101 of the coupling ring 140 is open exposing the snap ring 150 and rear washer 147. Returning to FIG. 5B and moving still forward along the length of the connector 500-B, the coupling ring's 540 inner surface comes up along side an outer surface of the internal plunger 560 just forward of the rear washer 547 and continues to follow the outer surface of the internal plunger closely until the front washer 543 is reached. The outer diameter of the internal plunger is constant from the rear end 561 till just forward of the front washer 543. Just front of the forward washer 543, the internal plunger outer diameter steps outward coming close to an inner diameter of the stationary housing 520 and forming a small ledge upon which the front washer 543 makes contact. This section is also shown in FIG. 5A and in greater detail in FIG. 5C. Front washer 543 precludes a metal-metal interface as the coupling ring 540 moves forward 503 or aft 501.

Referring again to FIG. 5B, the stationary housing 520 comprises external threads 525 on its back end 501. Just forward of the threads 525, the stationary housing 520 steps out to a larger inner and outer diameter. The outer diameter of the internal plunger steps out 560-2 filling in the step increase in stationary housing inner diameter of the stationary housing 520-4. Moving forward, the stationary housing 520 expands to a non-circular shaft to form the launcher rail mount 522. And finally, the stationary housing narrows and becomes circular again to form its coupling end 529 on the front end 503 of the connector. In accordance with an exemplary embodiment, the coupling end of the stationary housing has a quick connect and disconnect form and may include an o ring, not shown.

In this cross sectional view, internal threads 548 of the coupling ring 540 can be seen both engaging external threads 525 and open to the interior of the coupling ring 540. In accordance with an embodiment of the present invention, external stationary housing threads 525 and internal coupling ring threads are triple start threads, providing fine control of pin translation in a heavy and large connector. Non-standard, triple start threads provide a larger lead, the distance advanced parallel to the axis when the screw is turned one revolution, as compared to standard single threads. For a single thread, lead is equal to the pitch; for a double thread, lead is twice the pitch and so on. Triple threads lessen the rotation necessary to provide full contact pin insertion into the receiving receptacles, which is desirable in field conditions and for multiple or frequent testing applications.

FIG. 5A shows the internal plunger 560 moved forward 503 relative to the stationary housing 520. The alignment pins 517 now extend past the coupling end 529 of the stationary housing 520. In the embodiment of FIG. 5A, pins 515 are pushed forward to the front 503 edge of the coupling end 529. As described above, alignment pins 517 and the pin assembly 515 are connected to the internal plunger 560 and move with the internal plunger.

As the coupling ring 540 turns clock wise, front washer 543 presses on a step of the internal plunger 560 and the plunger moves forward relative to the stationary housing 520. The threads of the coupling ring 548 engage more of the stationary housing external threads 525 and fewer open internal threads, or none as shown, are visible. As the plunger 560 slides forward in the stationary housing 520, a void 520-3 is created between an inner diameter of the stationary housing 520 and an outer diameter of the internal plunger 560.

Figure 5C:
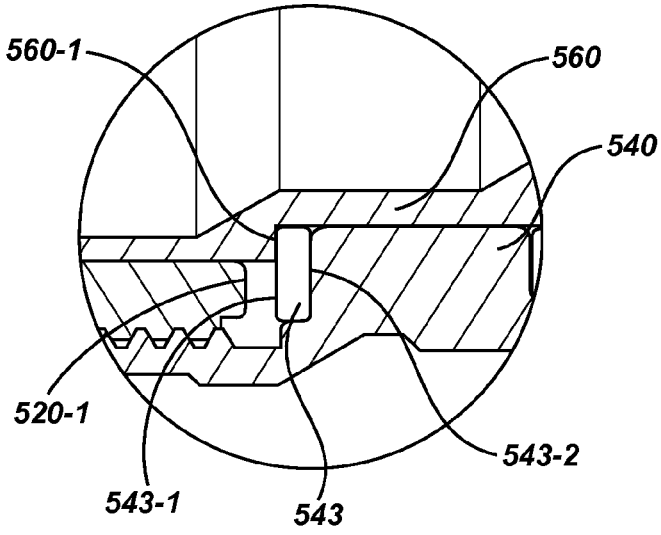
FIG. 5C shows an enlargement of a washer section in FIG. 5A in greater detail, in accordance with an exemplary embodiment of the present invention.

FIG. 5C shows an enlargement of a front washer section in FIG. 5A. From the most forward end of the coupling ring 540 moving aft, its largest threaded internal diameter 548 mates with the external threads of the stationary housing 520. From the forward threaded end, coupling ring 540 steps down to a second inner diameter to rest on the outer edge of front washer 543. Still moving aft, coupling ring 540 steps down in diameter forming an edge against which a rear side of the front washer 543-2 rests. An inner face of front washer 543 circumscribes the internal plunger 560. The front face 543-1 of the front washer 543 rests on face 560-1 and may, in accordance with an exemplary embodiment, contact an aft end 520-1 of the stationary housing when the pin assembly 515 and internal plunger 560 are moved fully forward 503. Therein, the aftmost end 520-1 of housing 520 serves as a forward stop.

Moving still in the aft direction, Referring again to FIG. 5B, from aft 501 to forward connector end 503, the coupling ring 540 steps out from a third diameter to a fourth diameter riding on an outer edge of rear washer 547 and forming a ledge at the front face of the rear washer 547. Moving still aft, the internal diameter of the coupling ring 540 remains open at this fourth diameter, forming its aft-most end.

Figure 6:
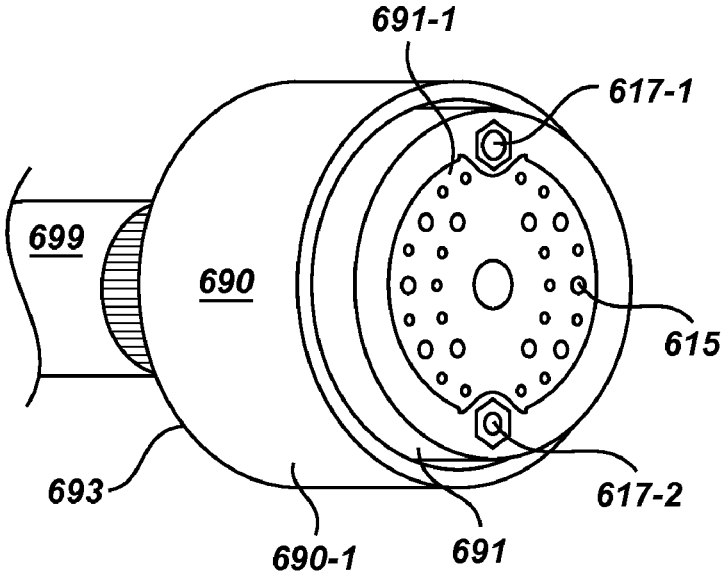
FIG. 6 shows a female connector compatible with a connector embodiment of the present invention.

FIG. 6 shows a female connector 693 compatible with an exemplary connector embodiment of the present invention. FIG. 6 shows an exemplary configuration of an insert or pin receptacle assembly 615 and a plug surface 691-1. In the female connector 693, receptacles for aligning pins 617-1 and 617-2 are 180 degrees apart and have different diameters to ensure proper orientation of the contact pin assembly with respect to the pin receptacle assembly. A female receptacle plug housing 691 extends beyond housing 690 for ready insertion into the opening of the coupling end 229, as shown in FIG. 2. Female receptacle plug housing 691, FIG. 6, encircles the plug 691-1 as well as the alignment pin receptacles 617-1, 617-2 but does not extend past the surface 691-1 which makes contact with the male connector, as shown. In accordance with exemplary embodiments of the present invention, the pin receptacle assembly 615, the plug surface 691-1 and its housing 691 insert into the connector opening 529, FIG. 5B. Contact pin and contact receptacle configurations or patterns are provided as examples for illustrative purposes.

In alternate embodiments, the diameter of, number of, and arrangement of the pin receptacles may vary as needed to accommodate varying pin contact diameters of a connector, in accordance with the present invention. Multiple receptacle configurations may be compatible with a same pin contact configuration. Actual pin number, size, and arrangement may vary in accordance with respective launcher rail requirements. A female connector 693 for an AIM-120 launcher rail may not have housing 690, and may only have a housing 691, FIG. 6, which inserts into opening 529, FIG. 5B, in accordance with an exemplary embodiment of the present invention.

Figure 7:
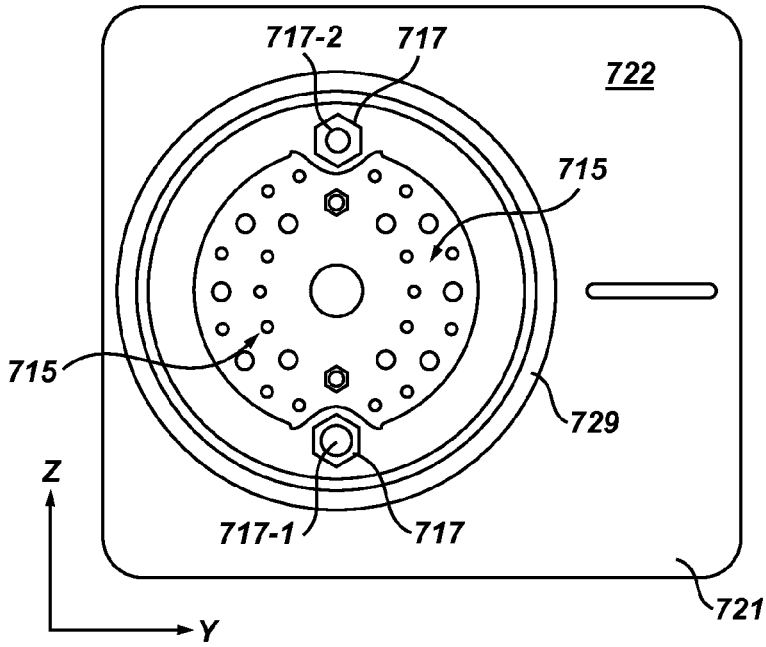
FIG. 7 shows a front view of a connector, in accordance with an exemplary embodiment of the present invention.

FIG. 7 shows a front view of a connector, in accordance with an exemplary embodiment of the present invention. The asymmetry of the launcher rail mount 722 is shown in the Y direction. The front face 721 of the stationary housing's launcher rail mount 722 faces into the missile launcher, not shown. In accordance with alternate embodiments of the present invention, the launcher rail mount 722 may have alternate configurations to accommodate mounting in an alternate launcher rails. In accordance with the embodiment of FIGS. 7, 5A, and 5B, the alignment pins 717-1, 717-2 and contact pins 715 are attached to the internal plunger. A shoulder 717, FIG. 7, of the alignment pins may rest on a surface 691-1 of the female plug, FIG. 6, when the female connector is connected to the connector 500-A, FIG. 5A, and the internal plunger 560 is in its full forward position 503. In accordance with an exemplary embodiment of the present invention, an outer shell 690-1 of the female connector 690 may circumscribe the outer diameter 729, FIG. 7, when the female connector 690 and its plug 691, FIG. 6, are inserted into the coupling end 729, FIG. 7, of the stationary housing.

The connecting cable 699 of the female connector 690, shown in FIG. 6, connects to the circuitry desired to be tested. Referring to FIG. 1, the cable connecting the pins 715, FIG. 7, to the desired tester exits the connector 100, FIG. 1, via opening 180 of the internal plunger 160 in the back end 101 of a connector in accordance with an exemplary embodiment of the present invention.

Figure 8:
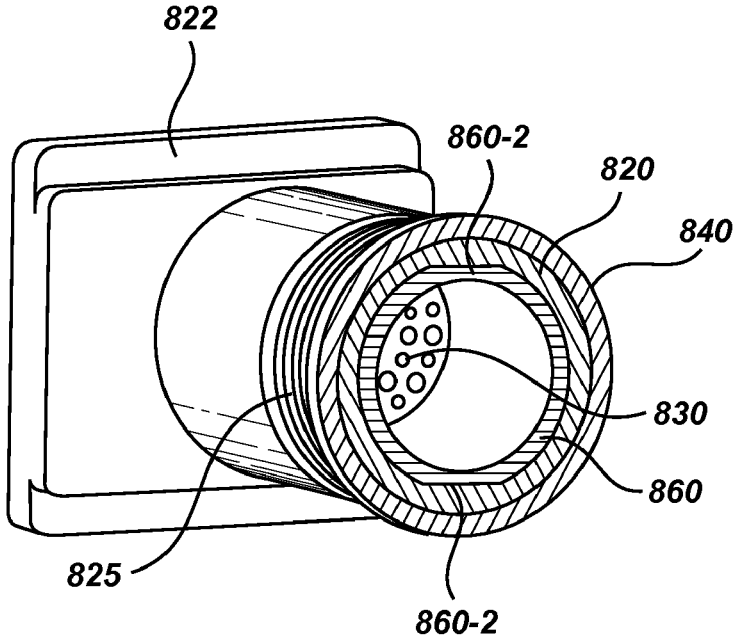
FIG. 8 shows a cross sectional view of an embodiment of a connector along line XX of FIG. 1, in accordance with an embodiment of the present invention.

FIG. 8 shows a cross sectional view of an embodiment of a connector along line XX of FIG. 1, in accordance with an embodiment of the present invention. At this cross section, flat portions 860-2 of the internal plunger 860 are visible. The outer surface of the stationary housing 820 and interior surface of the coupling ring 840 remain circular and are in threaded contact. FIG. 8 also shows the launcher rail mount 822 and threads 825 of the stationary housing 820. The flat portions 860-2 of the internal plunger are positioned 180 degrees across from each other and assist in preventing rotation of the plunger 860 as the coupling ring 860 is rotated about the stationary housing 820.

Figure 9A:
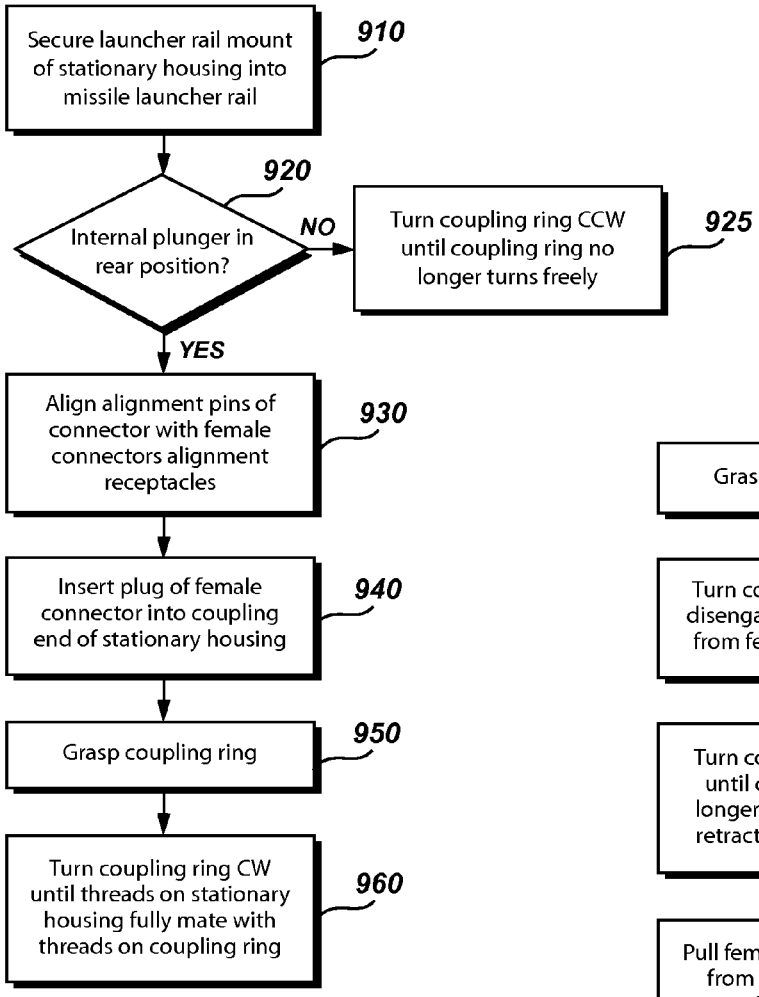
FIGS. 9A and 9B show a method of connecting and disconnecting a connector with a launcher rail and a female connector, respectively, in accordance with an exemplary embodiment of the present invention.

FIG. 9A shows a method of connecting a connector with a launcher rail and with a female launching connector in accordance with an exemplary embodiment of the present invention. A user will secure the launcher rail mount of the stationary housing into the missile launcher rail 910. At this point the connector is mechanically connected to the missile launch rail and the stationary housing of the connector is anchored to the missile launch rail and is not free to move. The user may verify that the internal plunger is in its rear position 920. Alternatively, the user verifies that the internal plunger is in its rear position before mounting the launcher rail mount of the stationary housing into the missile launch rail. In accordance with an exemplary embodiment, a backward stop 520-4 catches edge 560-2 of the internal plunger, as shown in FIG. 5A. Backward stop 520-4 is a step down of the inner diameter of the stationary housing 520 moving forward to aft. Full backward stop is made when edge 560-2 of the internal plunger 560 makes contact with edge 520-4 of the stationary housing. The internal plunger 560 is moved backward 501 by counter clockwise rotation of the coupling ring 540.

Referring again to FIG. 9A, if the contact pins are not fully retracted into the stationary housing, the user retracts the pin assembly before proceeding 925. Retraction of the pin assembly is further described in the disconnection method with reference to FIG. 9B.

With the contact pins fully retracted, the user aligns alignment pins of the connector with the alignment pin receptacles of the female connector 930 and the user inserts the plug of the female connector to be tested into the coupling end of the stationary housing 930, FIG. 9A. The connector is now mechanically connected to the female connector. The user then grasps the coupling ring 950 and rotates the coupling ring clockwise until full forward translation of the internal plunger is reached and, in turn, insertion of the contact pins into the female receptacles 960. Referring to FIG. 5C, full forward plunger position is achieved when the aftmost edge 520-1 of the stationary housing 520 meets front washer 543. When edge 520-1 contacts washer 543, the connector is electrically connected to the female connector for testing of the female connector itself and/or testing of the aircraft or missile launch circuit to which the female connector connects.

Figure 9B:
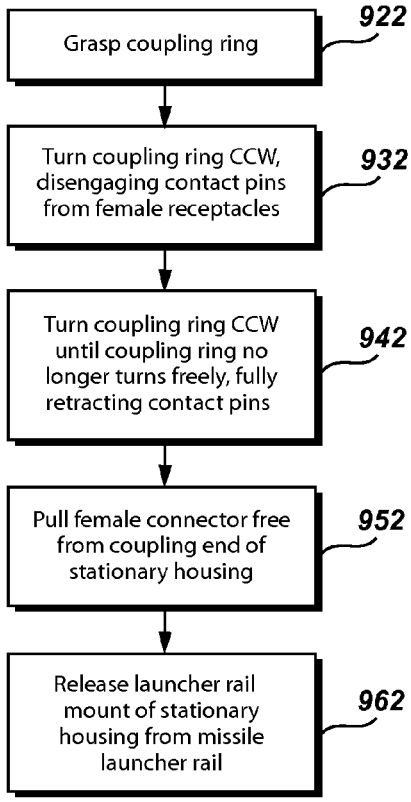

FIG. 9B shows a method of disconnecting a connector from a female connector and a launcher rail, respectively, in accordance with an exemplary embodiment of the present invention. Once the disconnection of the connector is needed or desired, the user will grasp the coupling ring 922. The user turns the coupling ring counter-clockwise, disengaging contact pins from female receptacles 932. The users continues turning the coupling ring counter-clockwise until the coupling ring no longer turns freely, fully retracting the contact pins from the female receptacles 942. With the pins fully disengaged from the female pin receptacles, the user may pull the female connector free from coupling end of stationary housing 952. With the female plug free from the coupling end of the stationary housing, the user can now release the launcher rail mount of the stationary housing from the missile launch rail 962.

Referring to FIG. 5A, full retraction of the contact pins and full backward internal plunger position is achieved when edge 560-2 of the plunger catches on internal edge 520-4 of the stationary housing.

The present invention provides a means of finally controlling forward and backward movement of an internal connector plunger along its axial center. A coupling ring with an internal triple-start thread rotates on an external triple-start thread of a stationary housing. With the stationary housing anchored in a missile launch rail, the coupling ring is rotated clockwise, the ring pushes the non-rotating internal connector plunger forward. Forward movement can continue with clockwise rotation until the forward washer has made contact with an aft most edge of the stationary housing. In accordance with an exemplary embodiment of the present invention, the contact pins attached to the internal plunger can displace a distance of approximately 0.500 inches with near one coupling ring rotation. An embodiment yielding a single rotation connection is compatible with some military applications and is facilitated with triple-start threads.

The total displacement distance of the internal plunger may be readily varied across embodiments of the present invention by increasing respective lengths of the coupling ring, stationary housing, and internal plunger. The configuration of the launcher rail mount of the stationary housing may also be varied in alternate embodiments to permit the secure mounting of the connector in alternate missile launcher rails. Contact pin and alignment configurations may also be varied across embodiments to accommodate alternate female connectors, perhaps on different aircraft or, again, on different missile launcher rail circuitry.

Figure 10:
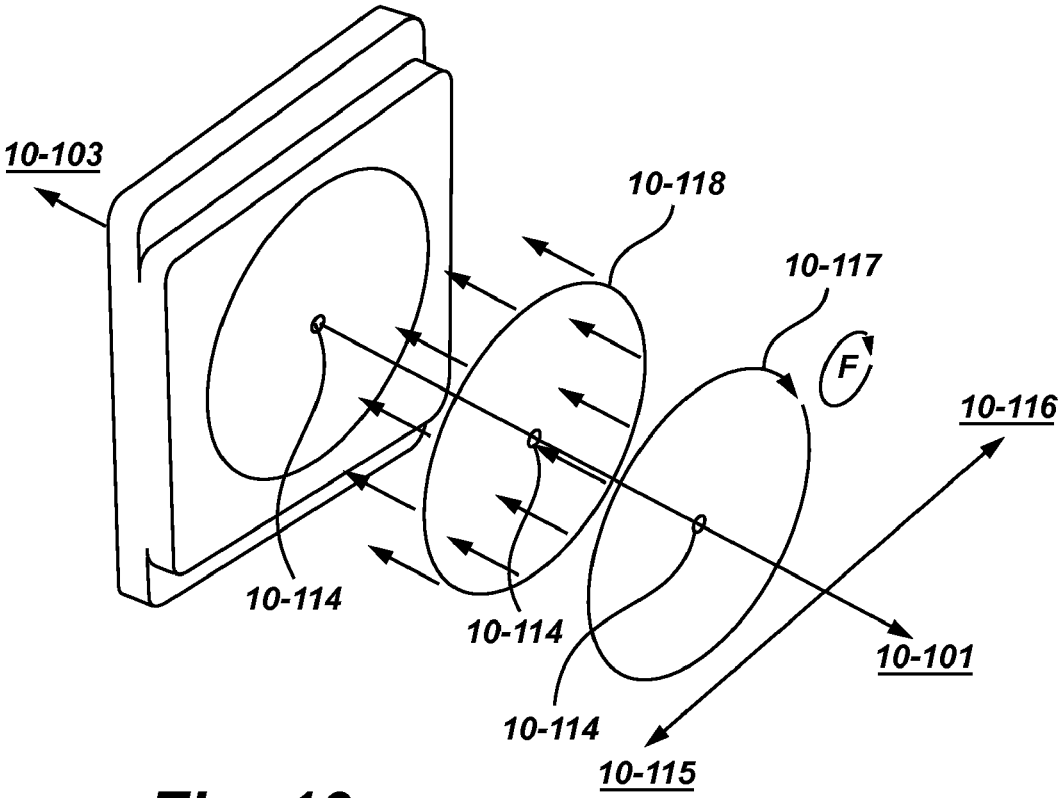

The triple start threads provide fine control over pin insertion into and extraction from the female plug via a hand grip about the coupling ring. Connector design translates this ring rotation about the plunger axis to a balanced circumferential force pushing the plunger forward or aft in a direction parallel to the plunger axis, and in turn, parallel to the contact pins. A left or right force 10-115, 10-116, FIG. 10, on the internal plunger may generate a moment of force on the pins, and eventual loosening or bending of the same. In accordance with the present invention, the anchored stationary housing is secured before pin insertion into a female plug markedly limiting or eliminating any off axis motion of the connector components. Further, rotational force, Fring 10-117, is translated to forward forces, Faxial 10-118, on the plunger and pins in the axial direction, 10-103.

The present invention greatly minimizes any normal forces applied to the axis of the connector. Referring to FIG. 5C, rotation of coupling ring 540 pushes an edge of the coupling ring on a front washer 543, which pushes on a circumferential edge of the plunger 560-1 and the plunger slides forward. The contact pins are parallel to the axis of the plunger and connected to the plunger, moving forward, or aft along with the plunger. Bending and stressing of contact pins is minimized when pins are aligned with respective female receptacles. The speed of insertion is readily controlled by hand rotation of the coupling ring. Any moment of inertia or contact pin to receptacle resistance is readily overcome with control using the coupling ring, in accordance with embodiments of the present invention.

Upon full forward displacement of the internal plunger, the contact pins and alignment pins are in contact with the female mating connector of the launcher rail. The rail is now ready for electrical testing. When the test is complete, the coupling ring can be rotated counter clockwise to move the internal connector plunger backward, which disengages the two connectors. Turning to FIG. 5B, when the coupling ring 540 is rotated counter clockwise, the rear washer 547 pushes backward 501 on snap ring 550 clamped around an outer circumference of an internal plunger 560. Turning to FIG. 5A, the coupling ring 540 can be rotated counter clockwise until an edge 560-2 of the connector plunger 560 stops against the rear stop 520-4 of the stationary housing 520, ensuring that the internal connector plunger is fully disengaged. In an alternate embodiment, a pair of hash marks on the coupling ring and stationary housing, respectively, align when the internal plunger is in the full rearward position. And similarly, a second pair of hash marks on respective coupling ring and stationary housing align when the contact pins, alignment pins, and internal plunger are in the most forward position.

In practice, as a user turns the coupling ring, the internal connector plunger moves forward or backward, only the coupling ring rotates, the internal connector plunger does not rotate. Rotation of the internal plunger would tangle the wires inside the connector. The internal connector plunger moves forward and backward by the force of the coupling ring against the front and rear washers, which apply force to the connector plunger. The front and rear washers facilitate slippage of the coupling ring alleviating torsion on the internal plunger and limiting off-thread metal-metal wear.

In accordance with an exemplary embodiment of the present invention, a user may verify that the plunger is in the rear most position by visual inspection of the connector opening at the coupling end of the stationary housing, noting the relative position of the alignment pins and contact pins to the outermost edge of the coupling end. Alternatively, the user may inspect the external threads of the stationary housing for one-half inch of exposed threads. Similarly, a user may verify full forward position of the contact pins by rotating the coupling ring clockwise until the internal threads of the coupling ring mate with all the external threads of the stationary housing.

An exemplary embodiment of the present invention has been successfully connected to and disconnected from a launch circuit's female connector and a missile launcher rail compatible with an AIM-120. Contact pins were repeatedly engaged and disengaged with the subject female receptacles using the device and method of an exemplary embodiment of the present invention. The launcher rail mount, 122 in FIG. 1, was readily and securely mounted in the missile launcher rail, an AIM-120 rail. And exemplary embodiment of the present invention has been successfully fit checked with a connector on an AIM-120 rail on two separate occasions. For one fit check, an exemplary connector of the present invention was unplated and for another fit check an exemplary connector, in accordance with an embodiment of the present invention, was plated with an anodic coating, NITUFF (Nimet Industries, South Bend, Ind., USA).

An exemplary embodiment of the present invention has been successfully connected and disconnected multiple times, electrically and mechanically to an AIM-120 missile launcher rail. Its relative small size approaches that of conventional D38999 series III connectors. As shown and described, the limiting forward and aft stops provide a user assurance that contact pins are properly engaged and disengaged, respectively. Manual rotation of the coupling ring provides a user friendly means of overcoming multi-pin contact insertion and extraction forces. Likewise the rotational action in combination with triple-threads yield movement of the pin assembly that is well-controlled. Embodiments of the present invention may readily include axial and radial torque limiting and loading features.

The invention as described and claimed herein provides a device and method for: securing/anchoring a stationary housing of a male connector within reach of a conventional female missile launcher rail connector; receiving a conventional female missile launcher rail connector on an open coupling end; and, with the male connector anchored and the female connector mechanically connected, inserting multiple pins into the conventional female connector via rotation of the coupling ring for testing of the female connector and associated circuitry. Anchoring the male connector in accordance with the present invention provides the counter force needed to enable forward movement of the multi-pin plunger. Anchoring the stationary housing in the launcher rail provides needed proximity of the connector to conventional female connectors to be tested. The coupling ring (FIG. 5, 540) provides a means for forwarding the plunger 560 and pins by manageable one handed rotation in field conditions.

Conventional male connectors may comprise a threaded collar for mechanical coupling to a female connector having external threads. In turn, both male and female connectors are tethered to respective cables and not held stationary. The male/female combination would have to be held to provide counter forces during pin insertion into the female receptacles. Such mechanical coupling of a male testing connector to a conventional female connector on a missile launch rail via a threaded collar is unsuitable for multiple reasons, which include the conventional female missile connector's lack of external threads. Additional reasons include the difficulty executing the two handed operation amongst a hung launcher rail in field conditions and the amount of manual force needed.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiment and after consideration of the appended claims and drawings.

What is claimed is:

1. An electrical connector for testing a missile launcher rail, the connector comprising:

a stationary housing comprising:

a launcher rail mount at a forward end of the housing and configured to be connected to a frame of the missile launcher rail;

a set of external threads on an aft end of the stationary housing;

an open coupling end on the forward end of the stationary housing;

a coupling ring connected to the stationary housing via threads, the coupling ring comprising:

a set of internal threads on a forward ring end which mate with the set of external threads on the stationary housing, engaging at least one external thread of the set of external threads on the stationary housing;

a step decrease in an internal ring diameter aft of the set of internal threads;

an internal plunger spanning a length of the connector, the plunger comprising:

a forward plunger end housed in the stationary housing;

a rear plunger end housed in the coupling ring;

contact pins in the forward plunger end;

a center plunger axis along the length of the connector;

wherein, the rear plunger end forms a rear connector end which accommodates a tester cable;

wherein the open coupling end on the forward end of the stationary housing forms a forward connector end configured to connect to a female connector of a missile launch rail for testing of the missile launch rail;

wherein the internal plunger is configured to translate forward or aft along the center plunger axis upon rotation of the coupling ring.

2. The connector according to claim 1, wherein:

the external threads of the stationary housing are triple start threads; and the internal threads of the coupling ring are triple start threads.

3. The connector according to claim 1, further comprising:

the internal plunger, further comprising:

alignment pins.

4. The connector according to claim 1, further comprising:

a front washer circumscribing the internal plunger and housed in the coupling ring.

5. The connector according to claim 1, further comprising:

a rear washer circumscribing the internal plunger and housed in the coupling ring.

6. The connector according to claim 1, further comprising:

a pair of opposing flat external surfaces along a section of the internal plunger.

7. The connector according to claim 1, further comprising:

a first external plunger diameter in the forward plunger end;

a step down to a second external plunger diameter in a mid plunger span; and another step down to a third external plunger diameter in the rear plunger end.

8. The connector according to claim 1, further comprising:

the coupling ring further comprising:

a first internal threaded diameter on a forward ring end;

a step decrease to a second internal diameter aft of the first internal threaded diameter;

a step decrease to a third internal diameter aft of the second diameter; and a step increase to a fourth internal diameter aft of the third diameter.

9. The connector according to claim 8, further comprising:

a front washer, circumscribing the internal plunger and housed in the coupling ring, adjacent to the step decreases to the second and third internal diameters of the coupling ring.

10. The connector according to claim 8, further comprising:

a rear washer, circumscribing the internal plunger, housed in the coupling ring, and adjacent to the step increase to the fourth internal diameter of the coupling ring.

11. The connector according to claim 10, further comprising:

a snap ring clamped around the outer diameter of the internal plunger aft of and adjacent to the rear washer.

12. A method of electrically coupling a connector to a missile launch rail, the method comprising:

anchoring a stationary housing of the connector into a frame of the missile launch rail;

inserting a plug into a coupling opening of a stationary housing of the connector;

grasping the connector by a coupling ring;

turning the coupling ring clockwise about the stationary housing;

pushing a front washer forward via an internal edge of the coupling ring;

pushing a circumferential edge of an internal plunger forward via the front washer; and moving contact pins connected to the internal plunger forward into pin receptacles of a female connector of the missile launch rail, which provides electrical coupling of the connector to the missile launch rail.

13. The method of claim 12, further comprising:

mating internal threads of the coupling ring with external threads of the stationary housing during the turning of the coupling ring.

14. The method of claim 12, further comprising:

moving contact pins connected to the internal plunger forward till a forward stop is reached, which provides electrical coupling of the connector to the missile launch rail.

15. The method according to claim 14, further comprising:

aligning alignment pins connected to the internal plunger with aligning receptacles in the plug.

16. The method according to claim 14, wherein:

the forward stop is reached when an aftmost edge of the stationary housing meets the front washer.

17. A method of uncoupling an electrical connector from a missile launch rail, the method comprising:

grasping a coupling ring of the connector;

turning the coupling ring counter clockwise until reaching a rear stop:

pushing an internal plunger aft via the turning of the coupling ring counter clockwise, wherein contact pins are secured to the internal plunger and retract from female receptacles with the pushing of the internal plunger aft;

removing a plug from an open coupling end of a stationary housing of the connector; and releasing a launch rail mount of the stationary housing of the connector from a frame of the missile launch rail.

18. The method according to claim 17, further comprising:

unmating internal threads of the coupling ring from external threads of the stationary housing during the turning of the coupling ring counter clockwise.

19. The method according to claim 17, further comprising:

pushing a rear washer aft via an internal edge of the turning of the coupling ring;

pushing backward on a snap ring, which is clamped around an outer circumference of an internal plunger, via the rear washer.

20. The method according to claim 17, wherein:

the reaching a rear stop comprises:

an external edge of the internal plunger meets an internal edge of the stationary housing.

* * * * *